US006834444B2

(12) United States Patent
Issler

(10) Patent No.: US 6,834,444 B2
(45) Date of Patent: Dec. 28, 2004

(54) SHOE HAVING REVERSE OPANKA STITCHING AND METHOD OF MAKING THE SHOE

(75) Inventor: David Issler, North Andover, MA (US)

(73) Assignee: Columbia Insurance Company, Omaha, NE (US)

( * ) Notice: Subject to any disclaimer, the term of this patent is extended or adjusted under 35 U.S.C. 154(b) by 5 days.

(21) Appl. No.: 10/300,524

(22) Filed: Nov. 20, 2002

(65) Prior Publication Data

US 2004/0093762 A1 May 20, 2004

(51) Int. Cl.[7] ..... A43B 13/28

(52) U.S. Cl. ..... 36/12; 36/22 R; 36/18; 12/142 C; 12/142 T

(58) Field of Search ..... 36/11.5, 16, 17 A, 36/17 PW, 18, 12, 22 R, 22 A; 12/142 A, 142 C, 142 T

(56) References Cited

U.S. PATENT DOCUMENTS

| | | | | |
|---|---|---|---|---|
| 1,270,218 A | * | 6/1918 | Schwander | 36/16 |
| 2,311,630 A | * | 2/1943 | Ayers | 12/142 F |
| 2,368,314 A | * | 1/1945 | Marx | 36/11.5 |
| 4,505,055 A | * | 3/1985 | Bergmans | 36/18 |
| 4,685,223 A | * | 8/1987 | Long | 36/6 |
| 5,784,736 A | | 7/1998 | Issler et al. | 12/142 B |
| 5,974,697 A | | 11/1999 | Tseng | 36/77 R |
| 6,029,301 A | | 2/2000 | Issler et al. | 12/142 B |
| 6,067,732 A | | 5/2000 | Dodge | 36/77 R |
| 6,226,895 B1 | * | 5/2001 | McClelland | 36/17 R |

* cited by examiner

*Primary Examiner*—Ted Kavanaugh
(74) *Attorney, Agent, or Firm*—St. Onge Steward Johnston & Reens LLC

(57) ABSTRACT

The invention relates to a method and apparatus for providing a shoe having an outsole having a side wall and a bottom. The side wall is connected to a peripheral edge of the bottom and also has a protrusion extending from the side wall, where an upper of the shoe connects to the protrusion.

15 Claims, 4 Drawing Sheets

SHOE HAVING REVERSE OPANKA STITCHING AND METHOD OF MAKING THE SHOE

FIELD OF THE INVENTION

The invention relates to a shoe having improved construction and, more particularly, a shoe having an outsole sewn to an upper employing unique stitching.

BACKGROUND OF THE INVENTION

There are a wide variety of shoe constructions. One construction method, known as Opanka construction, includes sewing the outsole to the upper of the shoe along an outer periphery of the outsole.

Referring to FIG. 1, an Opanka shoe construction is shown. The shoe 10 includes outsole 12 being secured to the upper 14 by threads 16 that pass through a plurality of aligning holes in both outsole 12 and upper 14. FIG. 1 shows a perspective view of upper 14 where the top of threads 16 is depicted.

FIG. 2 shows a cross sectional view of the shoe shown in FIG. 1. As shown, threads 16 pass through both upper 14 and outsole 12 from top to bottom and vice versa. To prevent threads 16 from being worn due to walking, thereby prolonging the life of threads and keeping outsole 12 secured to upper 14, the shoe includes a channel 18 to protect threads 16. Without channel 18, threads 16 may fail at a quicker rate and cause outsole 12 to separate from upper 14.

However, channel 18 may not prevent all objects, especially small rocks, dirt, or debris, from entering channel 18 and damaging threads 16. Additionally, having an outsole that shows both channel and threads 16 may detract from the appearance of the shoe.

In FIG. 3, an alternative embodiment of the Opanka construction shoe shown in FIG. 1, is shown having channel 20 on a side of outsole 12. In this fashion, one may argue that less debris or dirt will penetrate channel 20 due to its position on a side of outsole 12 as opposed to the bottom of outsole 12, as shown in FIG. 2. However, one may also argue that channel 20 is more visible on the side of the shoe as opposed to the bottom of the shoe and that the utilitarian benefits of placing channel 20 on the side is offset by the unattractiveness of making channel 20 more visible.

What is desired, therefore, is a shoe having an improved construction. Another desire is to provide a shoe where the stitching used for securing the outsole to the upper does not employ the use of a channel. A further desire is to provide a shoe that eliminates the need for a channel without sacrificing the strength of the shoe. Still a further desire is to provide a shoe construction that enhances the appearance of the shoe.

SUMMARY OF THE INVENTION

Accordingly, it is an object of the invention to provide a shoe having an improved construction.

Another desire is to provide a shoe that prolongs the life of the stitching used to secure the upper and outsole together.

A further desire is to provide a shoe where the stitching used for securing the outsole to the upper is hidden to improve appearance.

These and other objects of the invention are achieved by provision of a shoe having an outsole having a side wall and a bottom. The side wall is connected to a peripheral edge of the bottom and also has a protrusion extending from the side wall, where an upper of the shoe connects to the protrusion.

The shoe may connect the upper to the protrusion by sewing them together in at least one localized area.

In some embodiments, the upper and protrusion each have a respective top surface and a respective bottom surface and may include a thread used to sew the upper to the protrusion by cyclically passing the thread downwardly through the upper and protrusion, along the bottom surface of the protrusion, upwardly through the protrusion and upper, and along the upper surface of the upper.

In other embodiments, the side wall may have an upper end and a lower end, where the lower end connects to the peripheral edge and the protrusion extends from the upper end.

In further embodiments, the side wall may connect to an entire peripheral edge of the bottom such that the side wall and bottom define a cavity. The protrusion may also extend from the side wall along an entire circumference of the side wall, where the upper is connected to the protrusion along the entire circumference of the side wall.

In another aspect, the invention includes a method for providing a shoe, including the steps of providing a bottom of an outsole, connecting a side wall of the outsole to a peripheral edge of the bottom, extending a protrusion from the side wall, and connecting an upper of the shoe to the protrusion.

The method may also include the step of sewing the upper to the protrusion using a thread. The method may cyclically pass the thread downwardly through the upper and the protrusion, along a bottom surface of the protrusion, upwardly through the protrusion and the upper, and along an upper surface of the upper.

In some embodiments, the method further includes the step of connecting a lower end of the side wall to the peripheral edge of the bottom and extending the protrusion from an upper end of the side wall.

In further embodiments, the method may optionally connect the side wall to an entire peripheral edge of the bottom such that the side wall and the bottom define a cavity. Similarly, the method may also optionally extend the protrusion from the side wall along an entire circumference of the side wall and connect the upper to the protrusion along the entire circumference of the side wall.

The invention and its particular features and advantages will become more apparent from the following detailed description considered with reference to the accompanying drawings.

DETAILED DESCRIPTION OF THE DRAWINGS

Figure 1:
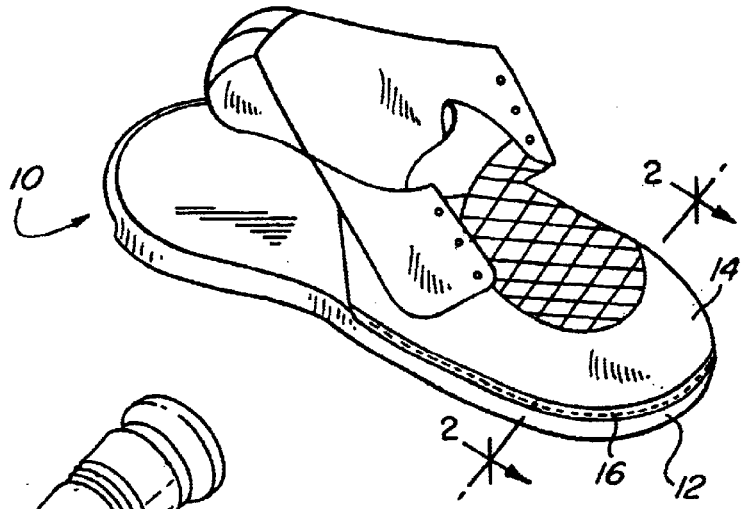
FIG. 1 (PRIOR ART)
FIG. 1 depicts a shoe representing the prior art.
Figure 2:
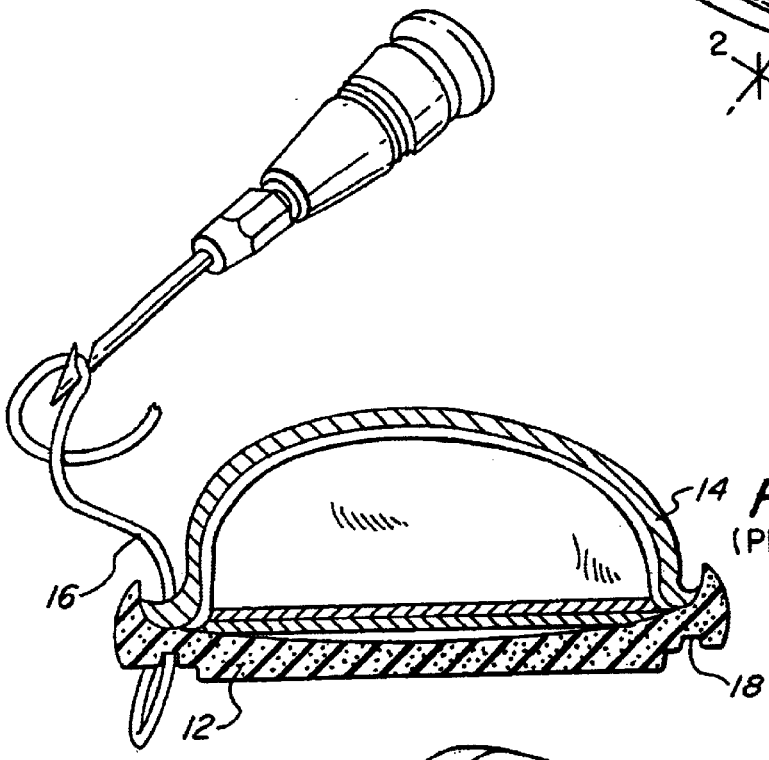
FIG. 2 (PRIOR ART)
FIG. 2 depicts a cross sectional view of the shoe in FIG. 1.
Figure 3:
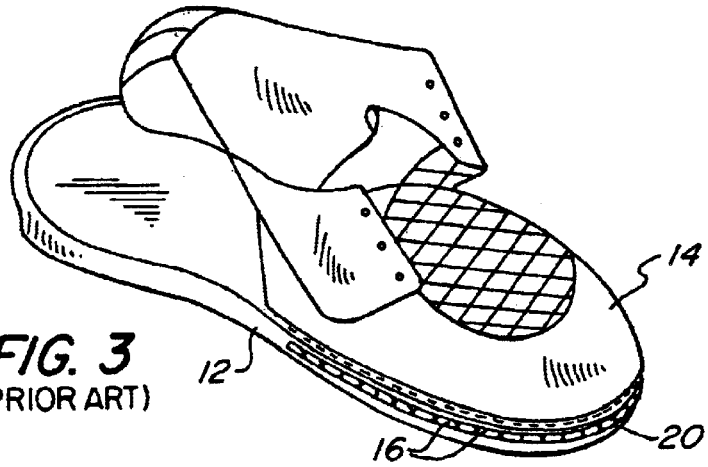
FIG. 3 (PRIOR ART)
FIG. 3 depicts a cross sectional view of another embodiment of the shoe in FIG. 1.

FIGS. 1, 2, and 3 depict a shoe having a traditional Opanka stitching. As shown, thread 16 used to sew upper 14 to outsole 12 is exposed on a side or a bottom of the shoe 10. Exposing thread 16 on either the side or bottom of shoe 10 presents the disadvantages described above.

Figure 4:
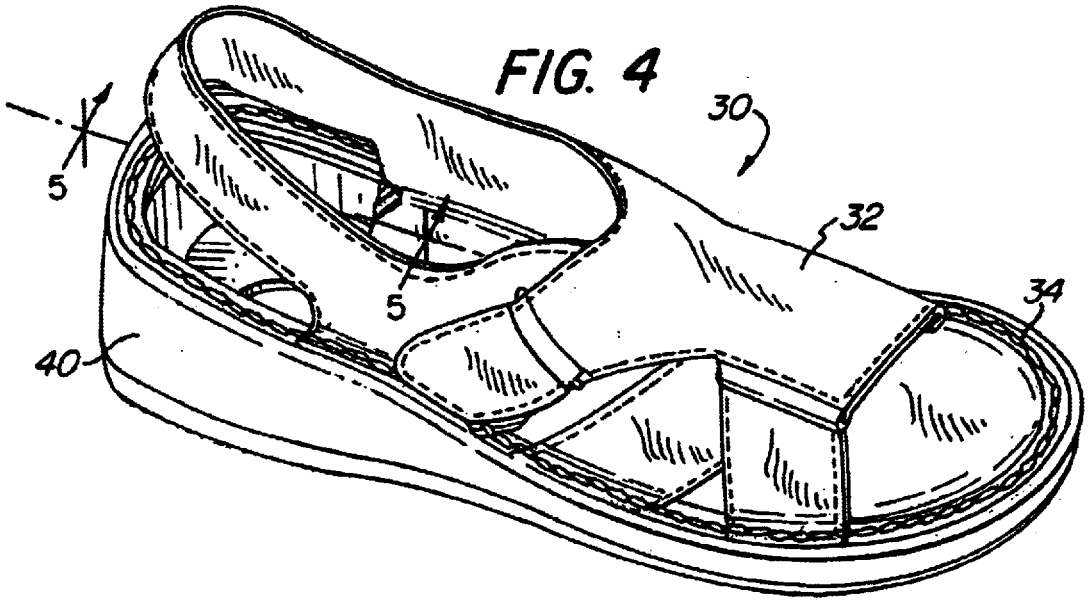
FIG. 4 depicts the shoe in accordance with the invention.

FIG. 4 depicts the shoe 30 in accordance with the invention. The type of stitching, or threading, employed in shoe 30 overcomes the disadvantages of shoes having traditional Opanka stitching. Shoe 30 employs a reverse Opanka stitch, which is more particularly depicted in the cross sectional views of FIGS. 5 and 5*a*. Shoe 30 includes outsole 40 and upper 32 being secured together with thread 34. Shoe 30 also includes protrusion 46, which provides a structure to which upper 32 secures. Although thread 34 passes along an upper surface of upper, similar to the traditional Opanka stitching, thread 34 does not require a channel or is visible from a side of shoe 30. Hence, the reverse Opanka stitching achieves the security and durability of the Opanka stitching of FIGS. 1–3 but hides and protects thread 34 from undue wear and improves the appearance of the shoe. The reverse Opanka stitching is described in more detail below under FIG. 5*a*.

Figure 6:
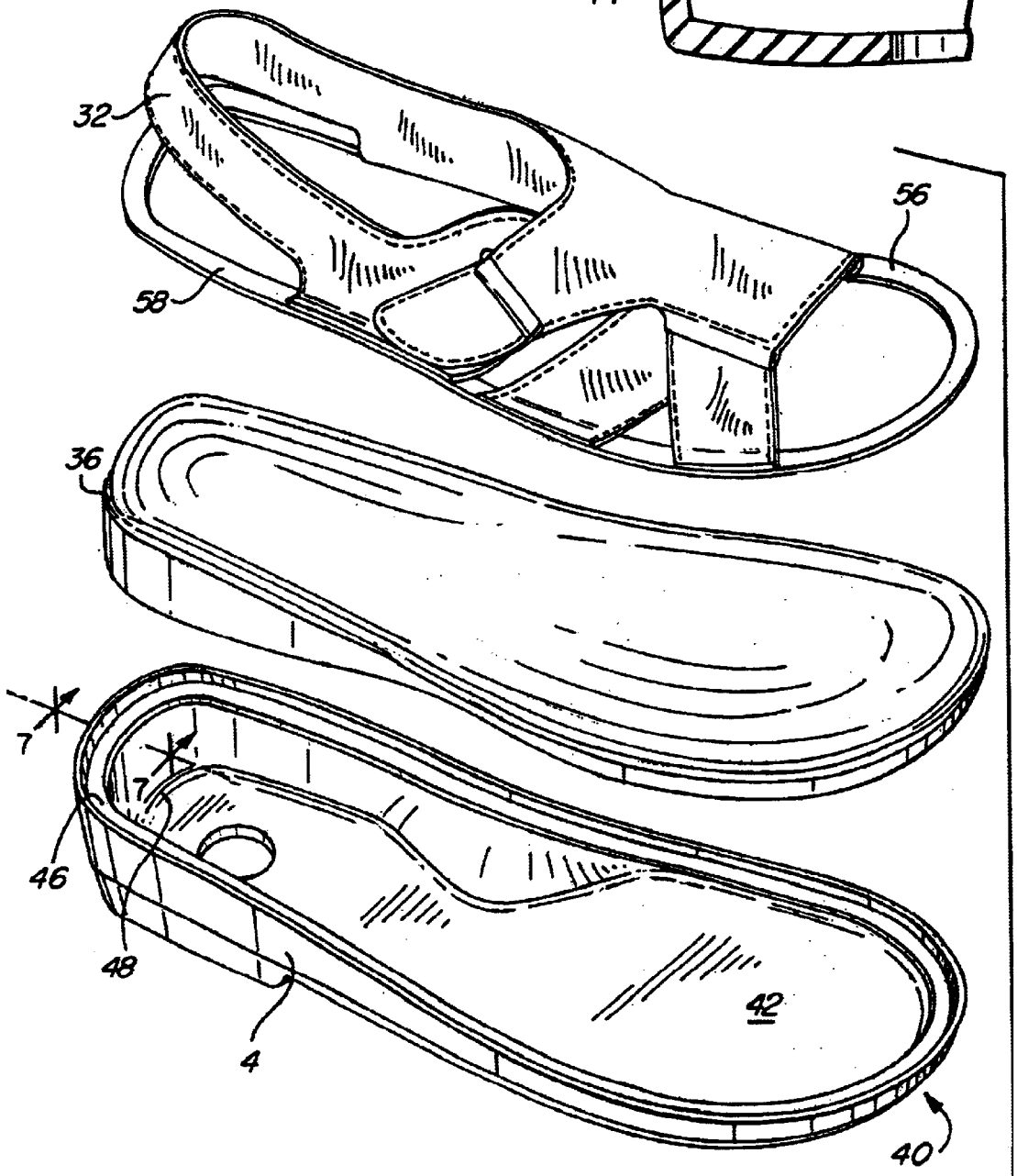
FIG. 6 separately depicts the components of the shoe shown in FIG. 4.

FIG. 6 separately shows the components of shoe 30, the components being outsole 40, insert 36, and upper 32. As shown, outsole 40 includes bottom 42 of outsole 40, side wall 44 of outsole 40, and protrusion 46 extending from side wall 44. Although FIG. 6 shows side wall 44 connected to bottom 42 along an entire peripheral edge 48 of bottom 42, other embodiments may have side wall 44 connected to bottom 42 along a localized area of peripheral edge 48. As shown, and not required for proper operation of shoe 30, side wall 44 and bottom 42 define a cavity for receiving and holding insert 36, which is anatomically shaped to conform to a user's foot and thereby provide comfort, support, and/or resiliency.

Figure 7:
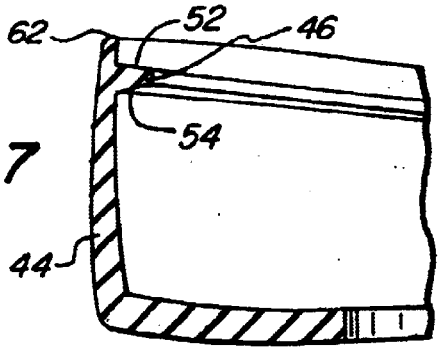
FIG. 7 depicts a cross sectional view of the outsole, which is one of the components of FIG. 6.

As more particularly shown in FIG. 7, protrusion 46 extends from side wall 44 and includes a top surface 52 and bottom surface 54. Upper 32 also includes a top surface 56 and bottom surface 58, as shown in FIG. 6. As seen in FIG. 5*a*, bottom surface 58 of upper 32 sits on top surface 52 of protrusion 46 and thread 34 cyclically passes downwardly through upper 32 and protrusion 46, along bottom surface 54 of protrusion 46, upwardly through protrusion 46 and upper 32, and along top surface 56 of upper 32. This cycle repeats until upper 32 is sewn to protrusion 46 to a desired strength and thread 34 achieves a desired appearance.

Sewing upper 32 to protrusion 46 using an Opanka stitching provides an enhanced appearance of shoe 30 and prolongs the life of thread 34, advantages not available with traditional Opanka stitched shoes. By not exposing the part of thread 34 that passes along bottom surface 54 of protrusion 46 to the elements, such as debris or walking surfaces, the life of thread 34 is prolonged. Moreover, the appearance of shoe 30 is enhanced over the shoe shown having a channel on a side of the outsole, as shown in FIG. 3.

In the embodiment shown in FIG. 4, thread 34 sews upper 32 to protrusion 46 along an entire periphery of shoe 30. In other embodiments, thread 34 may sew upper 32 to protrusion 46 along at least one localized area of the periphery of shoe 30. It should be known that further embodiments may provide protrusion 46 extending along an entire periphery of side wall 44 but may have upper 32 secured to protrusion 46 in the at least one localized area instead of the entire periphery. In these embodiments, an aesthetically pleasing covering, such as a leather strip, may be used to cover areas of protrusion 46 that are exposed or not covered by upper 32 in the at least one localized area. Likewise, in still further embodiments, upper 32 may be secured to protrusion 46 along an entire periphery of side wall 44 but side wall may be connected to bottom 42 along a localized area or areas of peripheral edge 48. Hence, the extent thread 34 extends along a periphery of side wall 44, the extent side wall 44 extends along peripheral edge 48, and the extent protrusion 46 extends along side wall 44 are independent from one another.

Figure 5:
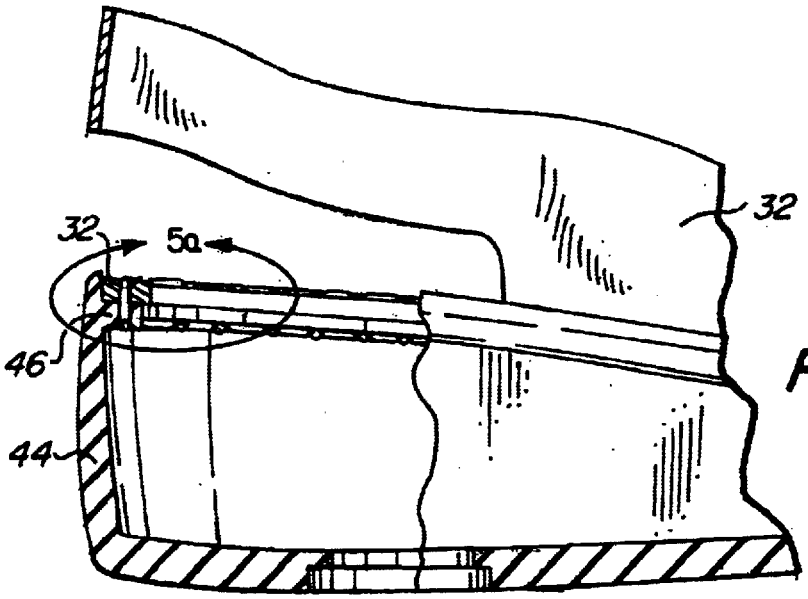
FIG. 5 depicts a cross sectional view of shoe shown in FIG. 4.
Figure 5A:
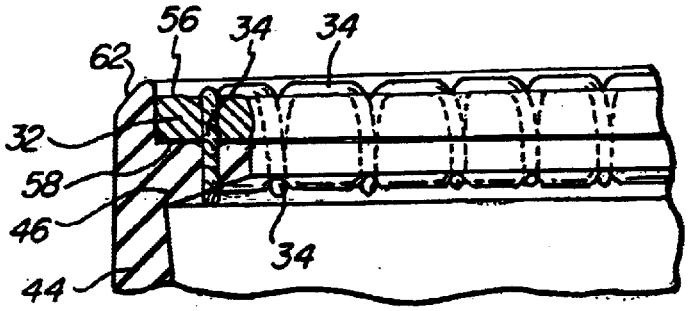
FIG. 5*a* depicts an exploded view of a portion of the cross sectional view of FIG. 5.

In the embodiment shown in FIGS. 5, 5*a*, and 7, side wall 44 is connected to bottom 42 in a generally perpendicular manner and, similarly, protrusion 46 extends from side wall 44 in a generally perpendicular manner. However, in other embodiments, side wall 44 and protrusion 46 are angularly connected to bottom 42 and side wall 44, respectively. Protrusion 46 is located below an uppermost portion 62 of side wall 44 so that, when upper 32 is sewn to protrusion 46, top surface 56 of upper 32 is generally flush with uppermost portion 62. However, the location of protrusion 46 along side wall 44 is not limited to this region and may extend from side wall 44 in any location so long as thread 34, when upper 32 is sewn to protrusion 46, is not exposed beneath or on a side of outsole 40, thereby enhancing the appearance of shoe 30 and prolonging the life of thread 34.

Thread 34 is any flexible line, string, yarn, or other object that passes through upper 32 and protrusion 46 to secure upper 32 and protrusion 46 together. Thread 34 is typically easily bendable with a high level of strength, such as cloth, fabric, leather, fishing line, rope, and the like.

Figure 8:
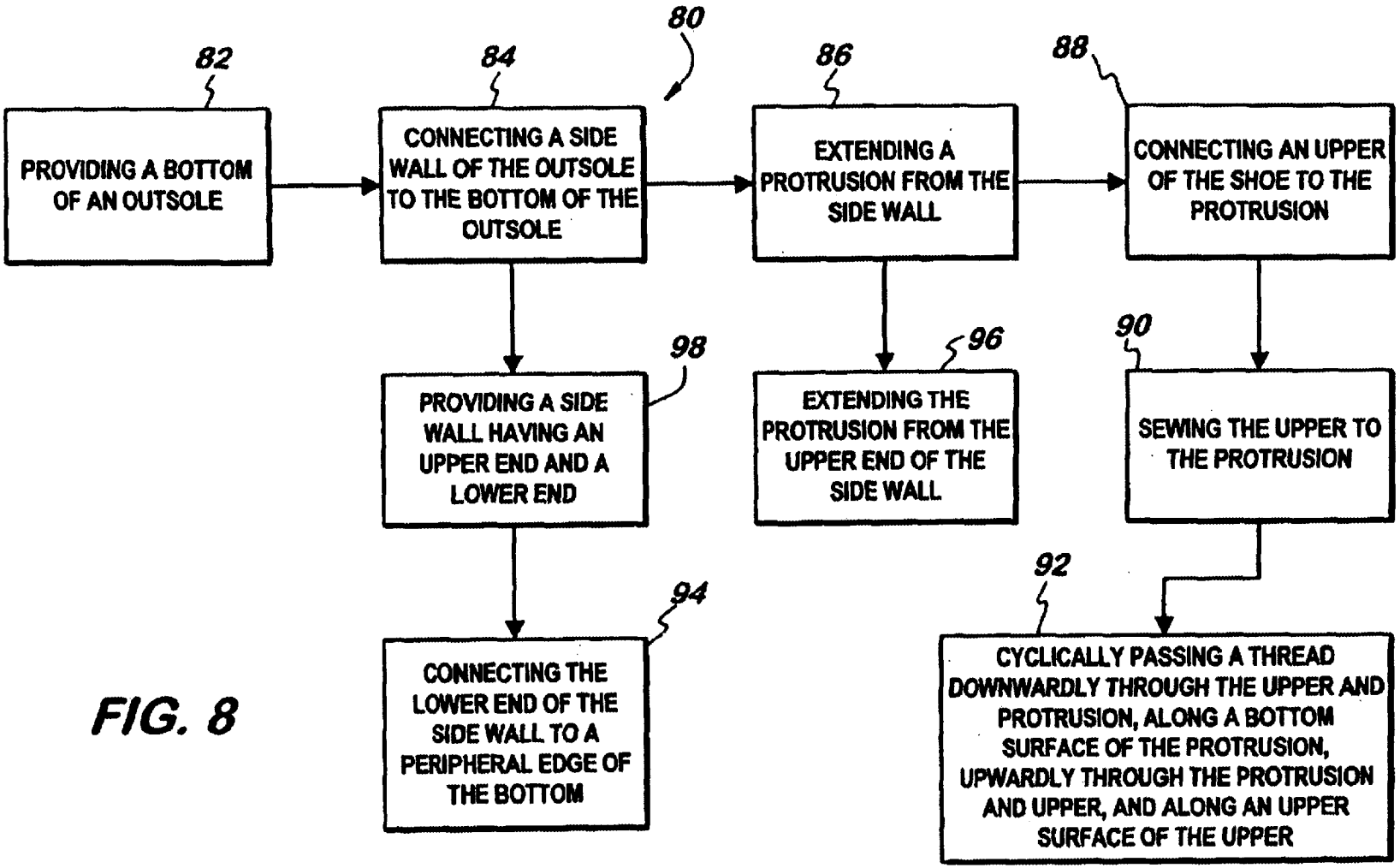
FIG. 8 depicts a method for providing a shoe with a reversed Opanka stitching.

FIG. 8 depicts a method 80 for providing a shoe with a reverse Opanka stitching. Method 80 includes the steps of providing 82 a bottom of an outsole, connecting 84 a side wall of the outsole to a peripheral edge of the bottom of the outsole, extending 86 a protrusion from the side wall, and connecting 88 an upper of the shoe to the protrusion. By connecting 88 the upper to the protrusion, method 80 provides a shoe with a reverse Opanka stitching that overcomes the disadvantages of shoes having traditional Opanka stitching, as mentioned above.

Optionally, method 80 may include the step of sewing 90 the upper to the protrusion using a thread. In this embodiment, method 80 cyclically passes 92 the thread downwardly through the upper and the protrusion, along a bottom surface of the protrusion, upwardly through the protrusion and upper, and along an upper surface of the upper. Method 80 cyclically passes 92 the thread in this manner until a desired amount of stitching is achieved.

More particularly, method 80 may include, upon providing 98 a side wall having an upper end and a lower end, the step of connecting 94 the lower end of the side wall to the peripheral edge of the bottom and extending 96 the protrusion from the upper end of the side wall.

Although method 80 provides a shoe, as shown in FIGS. 4–7, having the side wall connected to an entire peripheral edge of the bottom such that the side wall and bottom define a cavity, method 80 need not connect the side wall to the bottom in this fashion and may connect 84 the side wall to selected areas of the bottom. Similarly, method 80 may extend 86 the protrusion from the side wall along selected areas of the side wall instead of extending the protrusion continuously around the circumference of the side wall. Additionally, method 80 may connect 88 the upper to the protrusion along selected areas of the protrusion instead of a continuous stitch, as shown in FIG. 4.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A shoe, comprising:

an outsole having a side wall and a bottom, said side wall extending outwardly from said bottom and being connected to a periperhal edge of said bottom; an upper, said side wall having a protrusion; and a thread extending through said upper and said protusion, without extending through said bottom, for connecting said upper to said protusion.

2. The shoe according to claim 1, wherein said upper is sewn to said protusion in at least one localized are.

3. The shoe according to claim 1, said upper and said protusion have a respective top surface and a respective bottom surface.

4. The shoe according to claim 3, further comprising a thread used to sew said upper to said protrusion, said thread cyclically passing downwardly through said upper and said protrusion, along said bottom surface of said protrusion, upwardly through said protrusion and said upper, and along said upper surface of said upper.

5. The shoe according to claim 1, said side wall having an upper end and a lower end, said lower end connecting to the peripheral edge and said protrusion extending from said upper end.

6. The shoe according to claim 1, said side wall is connected to an entire peripheral edge of said bottom such that said side wall and said bottom define a cavity.

7. The shoe according to claim 6, said protrusion extending from said side wall along an entire circumference of said side wall.

8. The shoe according to claim 7, said upper is connected to said protrusion along the entire circumference of said side wall.

9. A method for providing a shoe, comprising the steps of:

providing a bottom of an outsole;

connecting a side wall of the outsole to a peripheral edge of the bottom;

extending the side wall upwardly from the bottom;

extending a protrusion from the side wall;

and connecting an upper of the shoe to the protrusion; and extending a thread through the upper and the protusion, without extending through the bottom, for connecting the upper to the protusion.

10. The method according to claim 9, further comprising the step of sewing the upper to the protrusion using a thread.

11. The method according to claim 10, further comprising the step of cyclically passing the thread downwardly through the upper and the protrusion, along a bottom surface of the protrusion, upwardly through the protrusion and the upper, and along an upper surface of the upper.

12. The method according to claim 9, further comprising the step of connecting a lower end of the side wall to the peripheral edge of the bottom and extending the protrusion from an upper end of the side wall.

13. The method according to claim 9, further comprising the step of connecting the side wall to an entire peripheral edge of the bottom, such that the side wall and the bottom define a cavity.

14. The method according to claim 13, further comprising the step of extending the protrusion from the side wall along an entire circumference of the side wall.

15. The method according to claim 14, further comprising the step of connecting the upper to the protrusion along the entire circumference of the side wall.

* * * * *